United States Patent [19]

Takahashi et al.

[11] 4,370,809

[45] Feb. 1, 1983

[54] POWER CHAIN SAW

[75] Inventors: Hiroshi Takahashi, Fussa; Masatoshi Satoh, Tokyo, both of Japan

[73] Assignee: Kioritz Corporation, Tokyo, Japan

[21] Appl. No.: 247,210

[22] Filed: Mar. 24, 1981

[30] Foreign Application Priority Data

Mar. 26, 1980 [JP] Japan ..... 55-39841[U]

[51] Int. Cl.[3] ..... B27B 17/00

[52] U.S. Cl. ..... 30/381; 123/179 SE

[58] Field of Search ..... 30/381, 382, 383, 384; 173/170; 123/149 D, 179 SE, 185 A, 185 BA

[56] References Cited

U.S. PATENT DOCUMENTS

| | | | |
|---|---|---|---|
| 3,525,373 | 8/1970 | Kobayashi | 30/381 |
| 3,747,649 | 7/1973 | Densow | 30/381 |
| 3,844,360 | 10/1974 | Green et al. | 173/170 |
| 4,198,752 | 4/1980 | Bross | 30/381 |

*Primary Examiner*—Jimmy C. Peters

*Attorney, Agent, or Firm*—Fleit & Jacobson

[57] ABSTRACT

A power chain saw comprises a cylinder block and a crank-case having a forwardly extending housing formed integrally therewith, a carburetor is incorporated into the housing and a main handle is located on the power unit on its upper side and extends longitudinally between the rear end and the forward upper portion of the power unit.

6 Claims, 2 Drawing Figures

POWER CHAIN SAW

This invention relates to power chain saws and particularly, to a compact portable power chain saw which is capable of one-handed operation as well as two-handed operation.

Conventional power chain saws presently in general use are designed on the assumption that they will be operated using two hands, and comprise a power unit which is provided at its forward end with an auxiliary handle and at the rear end with a rear main handle. In the case of power chain saws of this type, when the operator operates the chain saw with one hand by the rear main handle only, it is impossible for him to maintain the chain saw in substantially horizontal operating position because the center of gravity of the chain saw is considerably forward of the operator's hand. In order to make one-handed operation of the power chain saw possible, an attempt has been made to provide power units having a main handle disposed on the top thereof in the range of the center of gravity of the power unit. Since there is provided a carburetor for an engine on the top of the power unit in upwardly projected relation, however, the main handle is required to be arranged in an elevated position beyond the carburetor. Thus, the power chain saws of this design have disadvantages that they are great in bulk and a great distance between the main handle and the center of gravity of the power unit results in increase in moment on the chain saw, which would make quick operation of the chain saws impossible.

It is a main object of the invention to provide an extremely compact power chain saw which eliminates the above-mentioned disadvantages.

A further object of the invention is to provide a power chain saw wherein a carburetor is incorporated into a power unit and the power unit is provided with a main handle extending longitudinally between the forward upper portion and the rearward portion of the power unit.

According to the present invention, the power unit comprises a crank-case and a cylinder block, the crank-case including an integral housing defining a space having an opening at the forward end thereof, and an integral lubricating oil tank extending horizontally rearwardly below the cylinder block. A carburetor is disposed in an upper portion of the space in the housing of the crank-case and attached to the crank-case in communication with the interior thereof. A fuel tank is disposed in a lower portion of the space of the housing and an air filter is disposed across the opening of the housing and held in place by detachably securing an apertured front cover to the opening of the housing. A longitudinally extending main handle is formed integrally with an engine cover surrounding the upper portion and the rear end of the cylinder block and secured to the crank-case at the forward end thereof.

Figure 1:
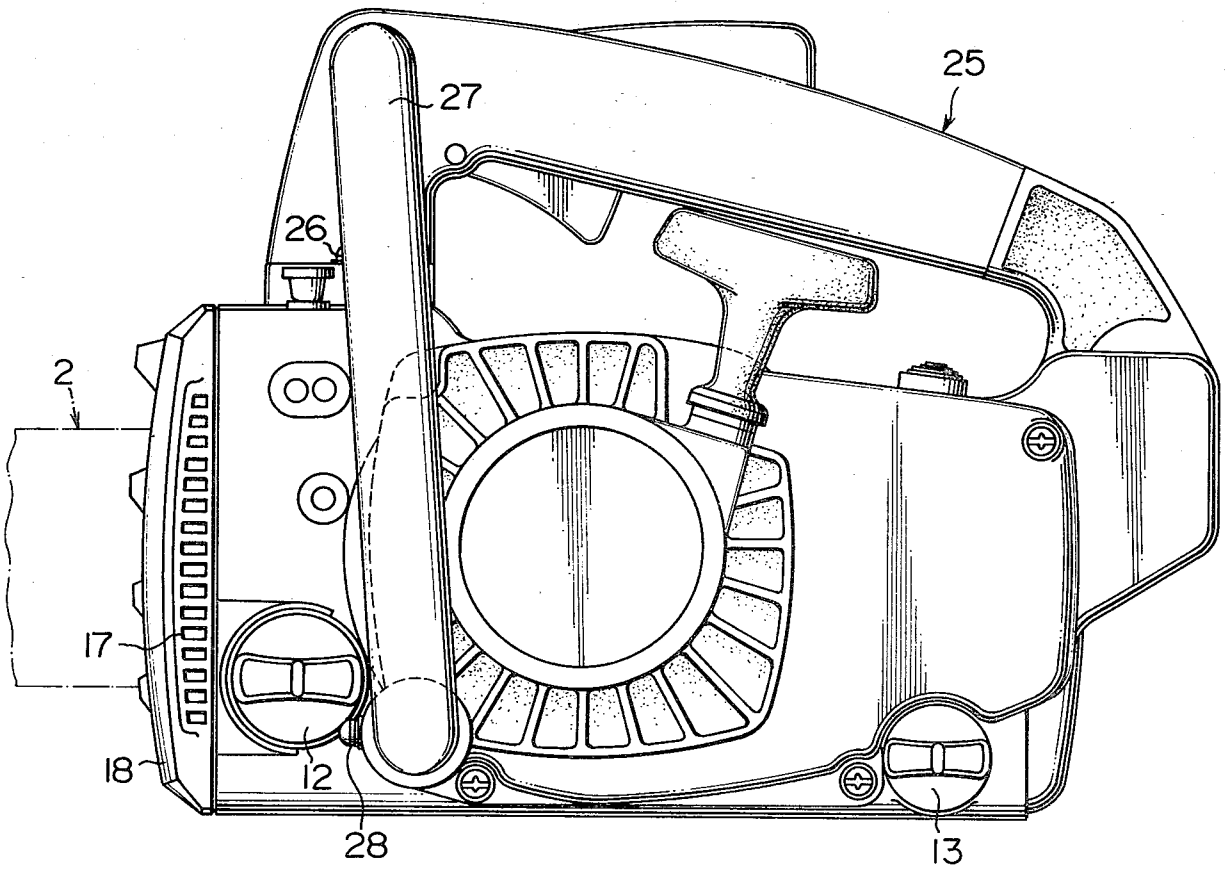
Figure 2:
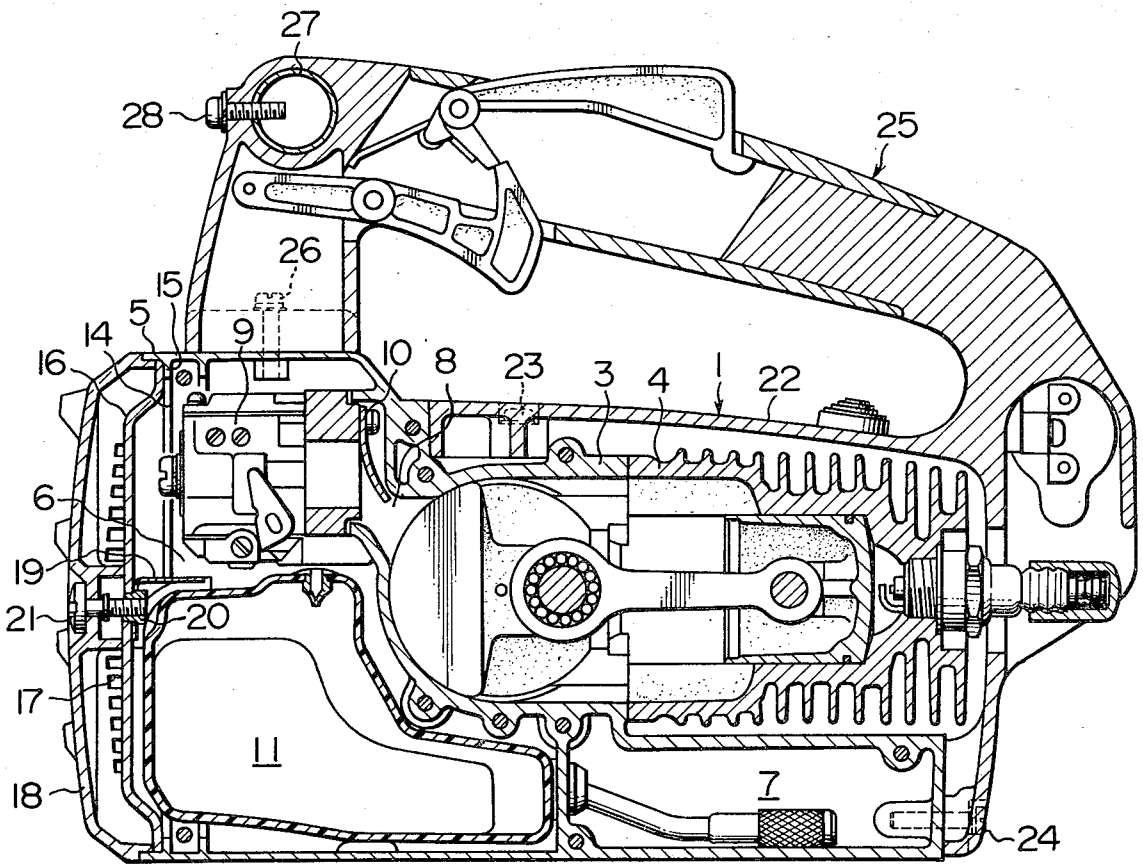

The invention will be more clearly understood from the following description made with reference to the accompanying drawings showing a preferred embodiment of the invention, in which:

FIG. 1 is a side elevational view of a power chain saw according to the invention; and FIG. 2 is a view similar to FIG. 1, showing in section a power unit of the chain saw.

Referring to FIGS. 1 and 2 of the drawings, a chain saw according to the invention comprises a power unit 1 and a saw chain assembly 2 carried by the power unit 1 on its side, the power unit 1 including a crank-case 3 and a cylinder block 4. The crank-case 3 has a forwardly extending housing 5 formed integrally therewith and defining a forwardly opened space 6. The crank-case 3 is provided with a lubricating oil tank 7 formed integrally therewith and extending rearwardly below the cylinder block 4.

The crank-case 3 is provided with an intake port 8 communicating with the interior thereof and a carburetor 9 is positioned in an upper portion of the space 6 of the housing 5 and secured to the crank-case 3 with a lead valve device 10 disposed between the intake port 8 and the carburetor 9. A fuel tank 11 preferably is of plastic material and disposed in a lower portion of the space 6 defined by the housing 5 of the crank-case 6 to supply fuel from the fuel tank into the carburetor 9. As can be seen in FIG. 1, there are provided caps 12 and 13 for the fuel tank 11 and the lubricating oil tank 7 on the side of the crank-case, respectively.

The housing 5 is provided with an inwardly projecting flange 15 adjacent the forward opening 14 thereof, against which an air filter 16 abuts at its periphery to close the space 6 of the housing. The opening 14 of the housing 5 is closed by a front cover 18 having air intake apertures 17 formed in the cover 18 at its periphery as can be seen in FIG. 1. The front cover 18 together with the air filter 16 is attached to the housing 5 of the crank-case 3 by screwing a fastening bolt 21 through the center portion of the front cover 18 into a nut 20 carried by a bracket 19 which is fixed to the housing 5 within the space 6. In operation of the power unit, air can be introduced from the exterior of the housing 5 through the air intake apertures 17 in the front cover 18 and the air filter 16 into the carburetor 9.

An engine cover 22 has a configuration adapted to surround the upper and rear portions of the cylinder block 4 and is attached to the crank-case 3 by means of set screws 23 and 24 threadedly received in the upper portion of the crank-case 3 and the rear end of the lubricating oil tank 7 in the integral form with the crank-case 3.

A main handle 25 extends longitudinally of the power unit between its rear end and the forward upper end thereof and is formed integrally with the engine cover 22 at the rear end of the handle. The main handle 25 is securely fixed at its forward end to the crank-case 3 by means of a set screw 26. A front auxiliary handle 27 extends transversely to the longitudinal axis of the power unit and has one end secured to the main handle 25 and the other end secured to the housing 5 of the crank-case 3 by means of fasteners 28, respectively.

According to the invention, it will be noted that the power unit has relatively flat configuration on the upper side thereof due to the fact that the carburetor is incorporated into the space 6 defined by the forwardly extending housing 5 which is formed integrally with the crank-case 3. Thus, the main handle can be arranged to extend over the length of the power unit in a relation closer to the upper surface of the power unit. In other words, the main handle is arranged in a position closer to the center of gravity of the power unit so that the chain saw can be easily operated using the main handle. The operator can operate the chain saw in a usual way not only with two hands by the front auxiliary handle and the main handle but also with one hand by the main handle only. It will be understood that the chain saw according to the invention is suitable for operations of cutting trees or their branches.

Furthermore, by removing the front cover and the air filter from the crank-case, the operator obtains access through the opening to the carburetor for its maintenance and services.

What we claim is:

1. A power chain saw comprising a power unit including a crank-case, a cylinder block, a forwardly extending housing formed integrally with said crank-case and having a space defined thereof, a carburetor disposed in the space and connected to said crank-case in communication with its interior, and a main handle positioned on the power unit on its upper side and extending longitudinally between the rear end and the forward upper portion of the power unit.

2. A power chain saw according to claim 1 wherein said housing has its forwardly opened end and an apertured front cover and an air filter are detachably secured to said opened end of the housing.

3. A power chain saw according to claim 1 wherein said space of the housing has upper and lower sections, said carburetor is disposed in the upper section of said space and a fuel tank is disposed in said lower section of said space in fluid communication with said carburetor.

4. A power chain saw according to claim 1 wherein said main handle is formed integrally with an engine cover surrounding the upper portion and the rear end of said cylinder block.

5. A power chain saw according to claim 1 wherein said crank-case is provided with a lubricating oil tank formed integrally therewith and extending rearwardly below said cylinder block.

6. A power chain saw according to claim 4 wherein said engine cover is secured to said crank-case and said main handle is secured at its forward end to said housing of said crank-case.

* * * * *